US007980211B2

(12) United States Patent
Ihlemann

(10) Patent No.: US 7,980,211 B2
(45) Date of Patent: Jul. 19, 2011

(54) CAM FOLLOWER FOR THE VARIABLE ACTUATION OF A GAS-EXCHANGE VALVE OF AN INTERNAL COMBUSTION ENGINE

(75) Inventor: Arndt Ihlemann, Hoechstadt (DE)

(73) Assignee: Schaeffler KG, Herzogenaurach (DE)

( * ) Notice: Subject to any disclaimer, the term of this patent is extended or adjusted under 35 U.S.C. 154(b) by 389 days.

(21) Appl. No.: 12/249,220

(22) Filed: Oct. 10, 2008

(65) Prior Publication Data

US 2009/0095241 A1 Apr. 16, 2009

(30) Foreign Application Priority Data

Oct. 12, 2007 (DE) ..... 10 2007 049 074

(51) Int. Cl.
*F01L 1/34* (2006.01)

(52) U.S. Cl. ..... 123/90.16; 123/90.48; 123/90.59

(58) Field of Classification Search ..... 123/90.16, 123/90.48, 90.59, 90.5
See application file for complete search history.

(56) References Cited

U.S. PATENT DOCUMENTS 7,350,486 B1 * 4/2008 Wu et al. ..... 123/90.16

* cited by examiner

*Primary Examiner* — Zelalem Eshete
(74) *Attorney, Agent, or Firm* — Lucas & Mercanti, LLP

(57) ABSTRACT

The cam follower has a roller, which is movable, between a first axial position and a second axial position and which alternately transmits elevations, which are different from one another. The cam has a cylinder-piston unit, which has a pressure medium space for moving the roller from the first axial position into the second axial position, and a spring means for moving the roller from the second axial position into the first axial position. The piston of the cylinder-piston unit is the roller and the roller has an end wall, which delimits the pressure medium space, and an annular collar which extends from said end wall and whose outer lateral surface serves as a cam pick-off surface. The inner lateral surface of the annular collar surrounds an outer section of the cylinder of the cylinder-piston unit.

9 Claims, 1 Drawing Sheet

CAM FOLLOWER FOR THE VARIABLE ACTUATION OF A GAS-EXCHANGE VALVE OF AN INTERNAL COMBUSTION ENGINE

This application claims the priority of DE 10 2007 049 074.9 filed Oct. 12 2007, the priority of which is hereby claimed and incorporated by reference herein.

FIELD OF THE INVENTION

The invention relates to a cam follower for the variable actuation of at least one gas-exchange valve of an internal combustion engine, having a roller axle, having a roller, which is mounted so as to be movable in its roller bore relative to the roller axle between a first axial position and a second axial position and which alternately transmits elevations, which are different from one another, of two cams which are arranged adjacently on a camshaft to the gas-exchange valve, having a cylinder-piston unit, which forms a pressure medium space, for moving the roller from the first axial position into the second axial position, and having a spring means for moving the roller from the second axial position into the first axial position.

BACKGROUND OF THE INVENTION

Generic cam followers are already known from DE 197 00 736 A1 and from JP 05-044410 A. In relation to cam followers which, for the alternating transmission of different cam elevations, have housing parts which are movable relative to one another and which can be coupled to one another by means of a pin locking arrangement which has a degree of play, these generic cam followers have a considerable advantage in that the unavoidable scatter in the pin play leads to deviating elevations of the gas-exchange valves, which adversely affect the charge exchange of the internal combustion engine. A further advantage of such cam followers is that the elevations, which are different from one another, of the cams need not be completely nested one inside the other, as is the case on account of the alternating contact, which is to be avoided, of the cams on the associated cam pick-off surfaces of the housing parts in the above-specified cam followers with a form-fitting pin locking arrangement.

The cam followers known from the cited documents do however have some disadvantages with regard to their structural design. Specifically, this relates to the structural series arrangement composed of the piston, which delimits the pressure medium space of the cylinder-piston unit, and the roller which is acted on with a reciprocating movement by the piston. Such a series arrangement leads not only to a voluminous installation space requirement of the cam follower in the direction of the roller axle, but also, on account of the mass action of the moving components, to an impairment of the attainable switching speed of the roller. However, since its switching process must be completed within the common base circle angle of the cams, and the time available for this, as is generally known, decreases with increasing rotational speed of the internal combustion engine, an excessively low switching speed would lead to a considerable restriction of the switching rotational speed, and consequently of the thermodynamic potential of the valve drive variability obtained by the cam follower.

OBJECT OF THE INVENTION

The present invention is therefore based on the object of developing a cam follower of the type specified in the introduction in such a way that the stated disadvantages are eliminated using simple means. Accordingly, the cam follower should be distinguished from the cited prior art firstly by as compact a design as possible and secondly by as low a mass as possible, in particular of the components which are moved together axially with the roller.

SUMMARY OF THE INVENTION

According to the invention, said object is achieved by means of the characterizing features of Claim 1, while advantageous refinements and embodiments of the invention can be gathered from the subclaims. Accordingly, it is intended that the piston of the cylinder-piston unit is the roller itself, with the roller having an end wall, which delimits the pressure medium space, and an annular collar which extends from the end wall and whose outer lateral surface serves as a cam pick-off surface and whose inner lateral surface surrounds the outer lateral surface of an outer section of the cylinder of the cylinder-piston unit in a low-leakage or pressure-medium-tight manner.

Such a functional integration of the roller into the cylinder-piston unit permits not only the cost-saving omission of the piston which is separate from the roller, as per the cited prior art, but also, on account of the relocation of the sealing gap, which is required for the build-up of pressure in the pressure medium space, between the outer section of the cylinder and the annular collar of the roller, as space-saving a design as possible of the cam follower in the direction of the roller axle.

In a development of the invention, said compact design can be improved yet further in that the end wall of the roller has, on the side facing away from the pressure medium space, at least one cylindrical recess for the support of the spring means, which is embodied as at least one coil pressure spring, on the roller. The installation space saving in the direction of the roller axle results in this case from the fact that the installation space required by the spring means need not be provided entirely adjacent to the roller, since the spring means runs at least partially in the cylindrical recess depending on the axial position of the roller. Said recess may be either a single, circular recess for receiving a coil pressure spring which is concentric with respect to the roller axle, or a plurality of circularly arranged recesses for receiving a corresponding number of coil pressure springs which are arranged eccentrically with respect to the roller axle.

In a further refinement of the invention, it is intended that the cam follower is a lever which is pivotably mounted in the internal combustion engine and which has side walls which run spaced apart from one another, with the cylinder-piston unit and the spring means being arranged entirely between the side walls. Levers of said type are known to a person skilled in the art in particular as a rocker arm or oscillating lever which is mounted at the end side on a support element or on an oscillating lever axle, or as a tilting lever which is mounted centrally on a support element or on a tilting lever axle. Alternatively, the cam follower may however also be mounted in a longitudinal guide in the manner of a bucket tappet.

In the case of the preferred design of the cam follower as a lever, it is also provided that the cylinder is rotatably mounted on the roller axle and is axially supported against one of the side walls via a sliding disk. In this case, in which the cylinder can follow the rotation of the roller, the roller axle is expediently to be fixed axially and radially in corresponding axle openings of the side walls, for example by means of end-side calking.

In a further design embodiment of the invention, it is intended that the roller is mounted by means of a tubular inner section of the cylinder on the roller axle, with the inner lateral surface of the inner section serving for mounting the cylinder on the roller axle, and with the roller bore being mounted in a movable fashion on the outer lateral surface of the inner section. Here, it may be provided that the inner section of the cylinder is fixed to the roller axle. In this case, fixing of the roller axle, for example by means of the above-mentioned end-side calking or by pressing into the axle openings, may be dispensed with since the inner section of the cylinder, which is fixed to the roller axle for example by means of pressing, prevents the roller axle from drifting out of the cam follower.

The cylinder may also be designed so as to have, at that end of the inner section which is remote from the pressure medium space, a radially outwardly extending flange which supports the spring means at the roller axle side. Here, in particular in the case of the cylinder being fixed to the roller axle, it may be expedient, and in the case of one or more spring means being arranged eccentrically with respect to the roller axle, it may be necessary, for the flange to serve as an axial plain bearing for the spring means.

It is also provided that, for conducting pressure medium, the roller axle is of hollow cylindrical design, has a first pressure medium bore which is connected to a first pressure medium duct which runs in the cam follower, and has a second pressure medium bore which is connected to the pressure medium space by means of a second pressure medium duct which runs in the inner section of the cylinder. Depending on the rotational degree of freedom of the cylinder on the roller axle, and/or for the benefit of radially non-aligned installation of the roller axle into the cam follower, it may be expedient here for the first pressure medium bore and the first pressure medium duct to be connected to one another by means of a first encircling groove and/or for the second pressure medium bore and the second pressure medium duct to be connected to one another by means of a second encircling groove.

Finally, it is intended that the above-specified features and embodiments of the invention can be combined with one another in any desired manner where possible and expedient.

BRIEF DESCRIPTION OF THE DRAWINGS

Further features can be gathered from the following description and from the drawings in which the invention is illustrated in simplified form on the basis of exemplary embodiments. Unless stated otherwise, identical or functionally equivalent features or components are provided here with the same reference signs. For illustrative reasons, said reference signs have been distributed approximately uniformly on the figures. In the drawings.

DETAILED DESCRIPTION OF THE DRAWINGS

Figure 1:
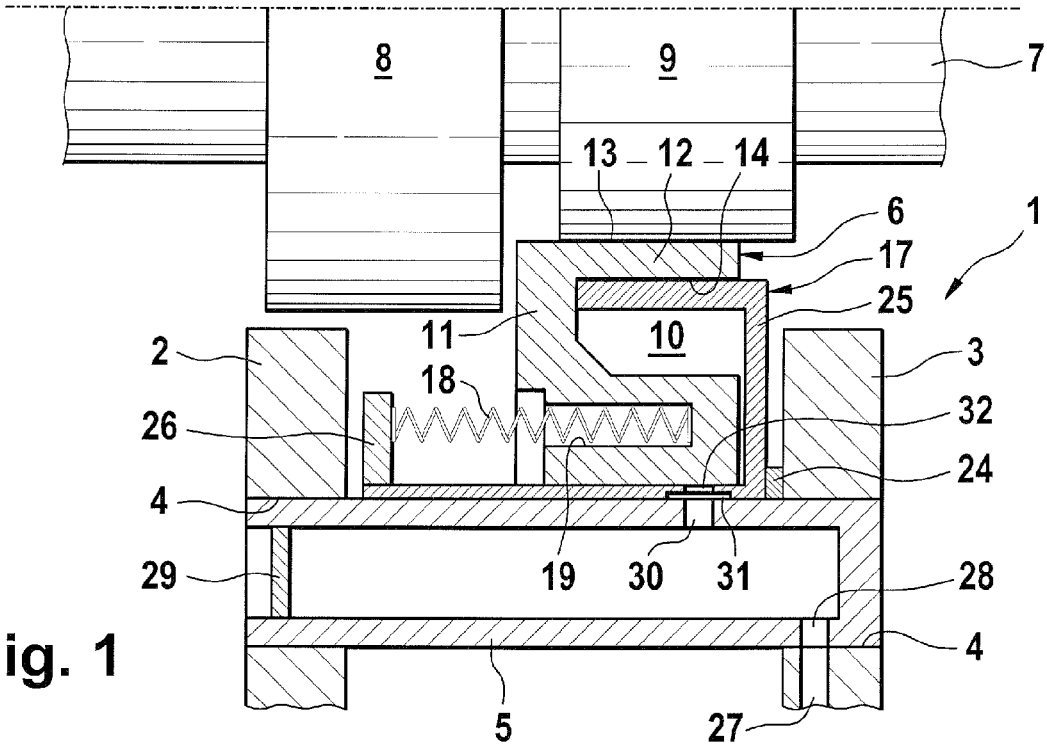
FIG. 1 shows, in a half-section, a detail of a cam follower according to the invention with the roller situated in the first axial position.

FIG. 1 discloses a detail, which is essential to the understanding of the invention, of a cam follower 1 for the variable actuation of one or more gas-exchange valves (not illustrated here) of an internal combustion engine. Here, the cam follower 1 is embodied as a lever which is pivotably mounted in the internal combustion engine, and has two side walls 2 and 3 which run spaced apart from one another and which have axle openings 4, which are aligned with one another, and a roller axle 5 which is held therein. A roller 6, which is mounted so as to be movable relative to the roller axle 5 between a first axial position as per FIG. 1 and a second axial position as per FIG. 2, serves for the alternating transmission of elevations, which are different from one another, of two cams 8 and 9 which are arranged adjacent to one another on a camshaft 7, to the gas-exchange valve(s).

The axial actuation of the roller 6 in the direction of the second axial position takes place by means of a cylinder-piston unit with a pressure medium space 10 which can be hydraulically pressurized, with it being provided according to the invention that the piston of the cylinder-piston unit and the roller 6 are the same component. The roller 6 has an end wall 11 which delimits the pressure medium space 10, and an annular collar 12 which extends from the end wall 11, the outer lateral surface 13 of which annular collar 12 serves as a cam pick-off surface and the inner lateral surface 14 of which annular collar 12 surrounds the outer lateral surface 15 of an outer section 16 of the cylinder 17 of the cylinder-piston unit so as to ensure a sufficiently fast build-up of pressure in the pressure medium space 10 with a sufficient sealing action. On account of the tolerances involved in component production, a certain degree of leakage of hydraulic medium at this point is however unavoidable, though may at the same time be desirable for the purpose of lubrication and/or cooling of the highly-loaded contact region between the roller 6 and the cams 8 or 9.

A spring means serves to return the roller 6 from the second axial position into the first axial position, which spring means, in this case in the form of a plurality of coil pressure springs 18 which are arranged in a circle so as to be distributed on the end wall 11 and eccentrically with respect to the roller axle, is supported at the roller side in cylindrical recesses 19 on that side of the end wall 11 which faces away from the pressure medium space 10. The number of recesses 19 is equal to or greater than the number of coil pressure springs 18, wherein the latter case is a measure for reducing the weight of the roller 6.

The mounting arrangement in the region of the roller axle 5 is designed such that the roller 6 is mounted in an axially and radially sliding fashion not directly on the roller axle 5 but rather with its roller bore 20 on the outer lateral surface 21 of a tubular inner section 22 of the cylinder 17. The mounting of the cylinder 17 on the roller axle 5 firstly makes it possible for the inner lateral surface 23 of the inner section 22 to be mounted in a floating fashion on the roller axle 5, and secondly makes it possible for the cylinder 17 to be fixed with its inner section 22 to the roller axle 5. In this exemplary embodiment, the roller axle 5 is in both cases fixed both against movement and also against rotation in the axle openings 4 of the side walls 2, 3 by means of known fastening processes such as end-side calking. If the cylinder 17 is mounted in a sliding fashion on the roller axle 5, the cylinder 17 may participate in the rotation of the roller 6 depending on the friction conditions of the contact surfaces involved. In this case, a sliding disk 24 is provided which supports the cylinder, at a base 25 which connects the outer section 16 to the inner section 22, axially against the side wall 3. In the case of the cylinder 17 being fixed for example by being pressed onto the roller axle 5, the sliding disk 24 may be dispensed with or else replaced by a spacer ring which positions the cylinder 17 axially on the roller axle 5.

The cylinder 17, which is embodied as a thin-walled deep-drawn part, has a radially outwardly extending flange 26 at that end of the inner section 22 which is remote from the pressure medium space, against which flange 26 the coil pressure springs 18 are supported at the roller axle side. With regard to the assemblability of the cylinder-piston unit, the flange 26 is a component which is produced separately from the cylinder 17 and which, after the roller 6 is mounted, is fastened to the inner section 22. The surface of said flange 26 is provided, at least on the side of the coil pressure springs 18, with good sliding properties, and serves as an axial plain bearing for the coil pressure springs 18 which possibly rotate on it. It is however also conceivable for the flange 26 to be integrally formed on the cylinder 17, to be provided with a sliding layer and, after the roller 6 is mounted, to be integrally formed on the inner section 22 for example in a flanging process.

The supply of hydraulic medium to the pressure medium space 10 takes place via a first pressure medium duct 27 which runs in the side wall 3 and which is connected to the lubricant supply of the internal combustion engine, and opposite which first pressure medium duct 27 is situated a first pressure medium bore 28 of the roller axle 5 which is of hollow cylindrical design for conducting pressure medium and which is fixed in a radially aligned fashion in the side walls 2, 3. The cavity of the roller axle 5, which cavity is sealed off by a closure plug 29, is connected to the pressure medium space 10 by means of a second pressure medium bore 30 and a second pressure medium duct, in this case in the form of an encircling groove 31 and a transverse bore 32, which runs in the inner section 22 of the cylinder 17.

Figure 2:
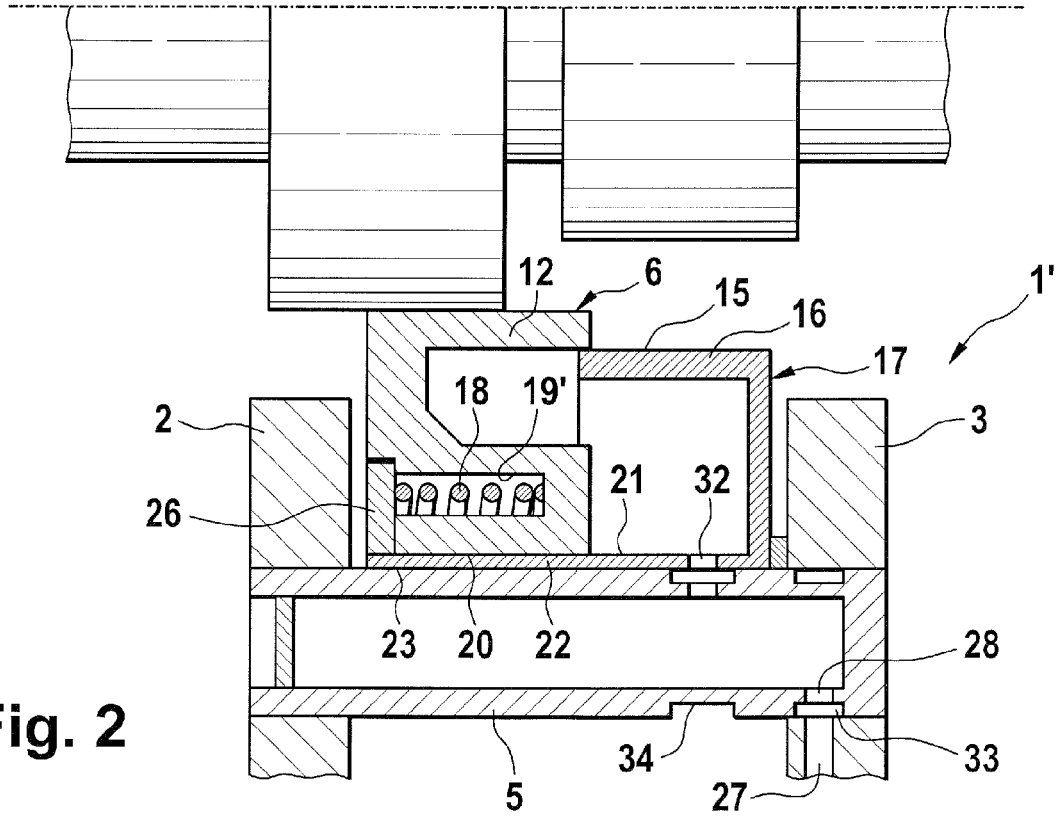
FIG. 2 shows, in a half-section, a cam follower according to the invention which is modified in detail in relation to FIG. 1, with the roller situated in the second axial position.

A cam follower 1' which is illustrated in FIG. 2 with the roller 6 in the second axial position differs from that explained above merely by design details. Said details relate firstly to the spring means which, in this case, is in the form of a single coil pressure spring 18 and is supported concentrically with respect to the roller axle 5 in a correspondingly circular cylindrical recess 19' of the roller 6 which, in this case, is substantially S-shaped in half-section.

Secondly, the supply and discharge of hydraulic medium to and from the pressure medium space 10 is configured such that it is possible to dispense with radially aligned installation of the roller axle 5 into the side walls 2, 3 with respect to the first pressure medium duct 27. For this purpose, the roller axle 5 has, in the region of the first pressure medium bore 28, a first encircling groove 33, such that the cavity of the roller axle 5 has a permanent connection to the first pressure medium duct 27 and consequently to the lubricant supply of the internal combustion engine. This also of course also applies in the case of a roller axle 5 which, if appropriate, is not fixed in the axle openings 4 of the side walls 2, 3, and which rotates. While the encircling groove 31 is formed into the inner section 22 of the cylinder 17 in the cam follower 1 illustrated in FIG. 1, the hydraulic function of said encircling groove 31 is provided in the cam follower 1' by a second encircling groove 34 on the roller axle 5.

LIST OF REFERENCE NUMBERS

1 Cam follower
2 Side wall
3 Side wall
4 Axle opening
5 Roller axle
6 Roller
7 Camshaft
8 Cam
9 Cam
10 Pressure medium space
11 End wall
12 Annular collar
13 Outer lateral surface of the annular collar
14 Inner lateral surface of the annular collar
15 Outer lateral surface of the outer section of the cylinder
16 Outer section of the cylinder
17 Cylinder
18 Spring means/coil pressure spring
19 Recess of the end wall
20 Roller bore
21 Outer lateral surface of the inner section of the cylinder
22 Inner section of the cylinder
23 Inner lateral surface of the inner section
24 Sliding disk
25 Base of the cylinder
26 Flange
27 First pressure medium duct
28 First pressure medium bore
29 Closure plug
30 Second pressure medium bore
31 Encircling groove
32 Transverse bore
33 First encircling groove
34 Second encircling groove

The invention claimed is:

1. Cam follower for a variable actuation of at least one gas-exchange valve of an internal combustion engine, comprising:

a roller axle;

a roller, which is mounted so as to be movable in a roller bore relative to the roller axle between a first axial position and a second axial position and which alternately transmits elevations, which are different from one another, of two cams which are arranged adjacently on a camshaft to the gas-exchange valve;

a cylinder-piston unit, which forms a pressure medium space, for moving the roller from the first axial position into the second axial position; and a spring means for moving the roller from the second axial position into the first axial position, wherein a piston of the cylinder-piston unit is the roller itself, with the roller having an end wall, which delimits the pressure medium space, and an annular collar which extends from the end wall and whose outer lateral surface serves as a cam pick-off surface and whose inner lateral surface surrounds an outer lateral surface of an outer section of a cylinder of the cylinder-piston unit in a low-leakage or pressure-medium-tight manner, and wherein the cam follower is a lever which is pivotably mounted in the internal combustion engine and which has side walls which run spaced apart from one another, with the cylinder-piston unit and the spring means being arranged entirely between the side walls.

2. Cam follower according to claim 1, wherein the end wall of the roller has, on the side facing away from the pressure medium space, at least one cylindrical recess for the support of the spring means, which is embodied as at least one coil pressure spring, on the roller.

3. Cam follower according to claim 1, wherein the cylinder is rotatably mounted on the roller axle and is axially supported against one of the side walls via a sliding disk.

4. Cam follower according to claim 1, wherein the roller is mounted by means of a tubular inner section of the cylinder on the roller axle, with the inner lateral surface of the inner section serving for mounting the cylinder on the roller axle, and with the roller bore being mounted in a movable fashion on the outer lateral surface of the inner section.

5. Cam follower according to claim 4, wherein the inner section of the cylinder is fixed to the roller axle.

6. Cam follower according to claim 4, wherein the cylinder has, at that end of the inner section which is remote from the pressure medium space, a radially outwardly extending flange which supports the spring means at the roller axle side.

7. Cam follower according to claim 6, wherein the flange serves as an axial plain bearing for the spring means.

8. Cam follower according to claim 4, wherein, for conducting pressure medium, the roller axle is of hollow cylindrical design, has a first pressure medium bore which is connected to a first pressure medium duct which runs in the cam follower, and has a second pressure medium bore which is connected to the pressure medium space by means of a second pressure medium duct which runs in the inner section of the cylinder.

9. Cam follower according to claim 8, wherein the first pressure medium bore and the first pressure medium duct are connected to one another by means of a first encircling groove and/or in that the second pressure medium bore and the second pressure medium duct are connected to one another by means of a second encircling groove.

* * * * *